US011464096B2

(12) United States Patent
Ostrovsky et al.

(10) Patent No.: US 11,464,096 B2
(45) Date of Patent: Oct. 4, 2022

(54) DIMMER WITH IMPROVED NOISE IMMUNITY

(71) Applicant: Leviton Manufacturing Co., Inc., Melville, NY (US)

(72) Inventors: Michael Ostrovsky, Melville, NY (US); Ozgur Keser, Melville, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 17/267,520

(22) PCT Filed: Sep. 28, 2018

(86) PCT No.: PCT/US2018/053260
§ 371 (c)(1),
(2) Date: Feb. 10, 2021

(87) PCT Pub. No.: WO2020/068089
PCT Pub. Date: Apr. 2, 2020

(65) Prior Publication Data

US 2021/0321502 A1 Oct. 14, 2021

(51) Int. Cl.

| | |
|---|---|
| ***H05B 47/10*** | (2020.01) |
| *H05B 45/31* | (2020.01) |
| *H05B 39/04* | (2006.01) |
| *H05B 41/392* | (2006.01) |

(52) U.S. Cl.
CPC ..... *H05B 47/10* (2020.01); *H05B 39/044* (2013.01); *H05B 41/392* (2013.01); *H05B 45/31* (2020.01)

(58) Field of Classification Search
CPC ..... H05B 47/10; H05B 41/392; H05B 45/31; H05B 39/044
See application file for complete search history.

(56) References Cited

U.S. PATENT DOCUMENTS

| | | | |
|---|---|---|---|
| 4,894,621 | A | 1/1990 | Koenig et al. |
| 5,020,026 | A | 5/1991 | Schreck et al. |
| 6,380,692 | B1 | 4/2002 | Newman |
| 6,717,394 | B2 | 4/2004 | Elms |
| 8,618,751 | B2 | 12/2013 | Ostrovsky et al. |

(Continued)

FOREIGN PATENT DOCUMENTS

| | | |
|---|---|---|
| WO | 2020068089 | 4/2020 |

OTHER PUBLICATIONS

International Search Report and Written Opinion of the International Searching Authority for International Application No. PCT/US2018/053260 dated Nov. 15, 2018, 8 pages.

(Continued)

*Primary Examiner* — Minh D A
(74) *Attorney, Agent, or Firm* — Matthew M. Hulihan; Heslin Rothenberg Farley & Mesiti PC

(57) ABSTRACT

A zero-crossing detection method, and devices incorporating the method, enable a selectively enabled bias to pull-up a zero-crossing signal, thereby enabling monitoring of the zero-crossing of both half-cycles of the alternating current (AC). This improves synchronization of the device in noisy environments and enables the detection of dimming problems during either half-cycle. Aspects can detect improper dimmer firing events on either polarity of the power cycle and restore normal dimmer operations when needed.

28 Claims, 6 Drawing Sheets

(56) References Cited

U.S. PATENT DOCUMENTS

| | | | | |
|---|---|---|---|---|
| 9,681,526 | B2 | 6/2017 | Ostrovsky et al. | |
| 9,974,152 | B2 | 5/2018 | Ostrovsky et al. | |
| 10,251,228 | B1 | 4/2019 | Lester | |
| 2002/0070719 | A1 | 6/2002 | Amarillas et al. | |
| 2003/0178892 | A1 | 9/2003 | Black et al. | |
| 2010/0194304 | A1 | 8/2010 | Mosebrook et al. | |
| 2010/0283391 | A1* | 11/2010 | Braunshtein | H05B 47/185 315/127 |
| 2012/0074792 | A1 | 3/2012 | Hodges et al. | |
| 2012/0229170 | A1 | 9/2012 | Scholder | |
| 2013/0162168 | A1 | 6/2013 | Ostrovsky | |
| 2014/0081474 | A1 | 3/2014 | Blakeley | |
| 2014/0327372 | A1* | 11/2014 | Zhang | H05B 45/10 315/224 |
| 2016/0278176 | A1* | 9/2016 | Chen | H05B 39/044 |
| 2017/0150566 | A1 | 5/2017 | Vanderzon | |
| 2017/0171950 | A1 | 6/2017 | Barna et al. | |
| 2017/0223808 | A1 | 8/2017 | Barna et al. | |
| 2018/0115161 | A1 | 4/2018 | Marsh-Croft | |
| 2018/0160494 | A1 | 6/2018 | Vanderzon | |
| 2019/0191518 | A1 | 6/2019 | Guan et al. | |
| 2020/0084852 | A1 | 3/2020 | DeJonge et al. | |
| 2021/0289596 | A1 | 9/2021 | Vanderzon et al. | |
| 2021/0321502 | A1 | 10/2021 | Ostrovsky et al. | |

OTHER PUBLICATIONS

International Search Report and Written Opinion for PCT/US2020/060328 completed Mar. 30, 2021, 22 pgs.

International Search Report and Written Opinion for PCT/US2020/070109 completed Aug. 18, 2020, 15 pgs.

Office Action in U.S. Appl. No. 17/325,164 dated Apr. 25, 2022, 39 pgs.

* cited by examiner

DIMMER WITH IMPROVED NOISE IMMUNITY

CROSS REFERENCE TO RELATED APPLICATIONS

This application is the National Phase filing under 35 U.S.C. § 371 of International Application No.: PCT/US2018/053260, filed on Sep. 28, 2018, and published on Apr. 2, 2020 as WO 2020/068089 A1. The content of WO 2020/068089 A1 is hereby incorporated herein by reference in its entirety.

BACKGROUND

In many retrofit and other applications, the field electrical wiring that is present in an electrical box has two wires—a hot/phase wire and a load wire—for connecting a load control (e.g. dimmer) to provide control for a load, such as a lighting load, and a ground wire. In such instances, a neutral wire may not be present in the electrical box. In these instances, if a digital dimmer is desired to be installed in the electrical box, preferably the dimmer needs to be a two-wire dimmer. Since a so-called two-wire dimmer does not require a neutral connection, it can be used as a replacement to a basic mechanical switch in retrofit installations when the neutral wire is not readily available. Please note that the term "two-wire" refers to the fact that the neutral wire is not required for proper operation of the dimmer. The term "two-wire" does not exclude additional physical wires being connected to the dimmer. For example, more than one phase wire can connect to the same terminal or a ground wire can be connected to a ground terminal of the two-wire dimmer. In addition, a wire for low voltage and/or remote communication (e.g. a traveler wire) can be connected to the two-wire dimmer for 3-way dimming applications.

One issue presented in the control of certain loads when no neutral wire is present is to provide a stable zero-crossing (ZC) reference in order to control the light intensity of the load without flickering. Dimmers capable of controlling a variety of different types of lighting loads (sometimes referred to as 'universal dimmers') should be able to provide quality dimming control across load types, for instance incandescent, light-emitting diode (LED), compact fluorescent lamp (CFL), magnetic low voltage (MLV), or any other non-linear (e.g. non-resistive) loads. However, in the case of LED, CFL and MLV loads, there is a phase shift between power line voltage and current through the load which makes it more difficult to synchronize with the power line zero-crossing because the neutral reference is not available.

SUMMARY

In one embodiment, provided is a dimmer for controlling conduction of a supply of alternating current (AC) power to a load. The dimmer includes a line input terminal and a load output terminal. The line input terminal is configured to be electrically coupled to the supply of AC power, and the load output terminal is configured to be electrically coupled to the load. The dimmer also includes a switching circuit electrically coupled in series between the line input terminal and the load output terminal, the switching circuit configured to be selectively controlled between an ON state and an OFF state, and the switching circuit having a control input configured to receive a firing signal. The dimmer includes a zero-crossing detector circuit configured to output a zero-crossing signal having a voltage level indicative of a zero-crossing of the AC power, the zero-crossing signal having a substantially square waveform varying between a low voltage level of substantially zero, a positive intermediate voltage level, and a positive high voltage level. The dimmer also includes a controller including a zero-crossing input, the zero-crossing input configured to receive the zero-crossing signal, and a selectively enabled bias arranged and configured to be selectively electrically coupled to the zero-crossing input. The controller is configured to selectively enable the bias to raise the voltage level of the zero-crossing signal from the low voltage level to the positive intermediate voltage level, and execute a synchronization algorithm to periodically provide the firing signal to the control input in accordance with a timing of the AC power.

In another embodiment, a method of operating a dimmer is provided. The dimmer includes a line input terminal configured to be electrically coupled to a supply of AC power, a load output terminal configured to be electrically coupled to a load, a switching circuit electrically coupled in series between the line input terminal and the load output terminal, a zero-crossing detector circuit configured to output a zero-crossing signal having a voltage level indicative of a zero-crossings of the AC power, the zero-crossing signal having a substantially square waveform, a controller including a zero-crossing input configured to receive the zero-crossing signal, and a bias arranged and configured to be selectively enabled by the controller to electrically couple to the zero-crossing input. The method includes determining a firing time based on a desired dimming level and a parameter of the AC power; detecting a first zero-crossing time $t_0$ when the voltage level of the zero-crossing signal transitions from a low voltage level of substantially zero to a positive high voltage level; calculating a time $t_1$ relative to $t_0$ based on the firing time; providing a first firing signal at $t_1$ the switching circuit; enabling the bias; performing a first detection of whether the zero-crossing signal transitioned to a positive intermediate voltage level; detecting a second zero-crossing time $t_2$ when the zero-crossing signal transitions to the low voltage level; calculating a time $t_3$ relative to $t_2$ based on the firing time; providing a second firing signal at $t_3$ to the switching circuit; performing a second detection of whether the zero-crossing signal transitioned to the positive intermediate voltage level; and disabling the bias.

In yet another embodiment, a zero-crossing detector circuit is provided for use in a dimmer having a switching circuit and a controller. The zero-crossing detector circuit includes an input configured to be electrically coupled to alternating current (AC) power, and an output configured to be electrically coupled to the controller. The zero-crossing detector circuit is configured to provide a tri-state zero-crossing signal to the output, the tri-state zero-crossing signal having a low voltage level of substantially zero, a positive intermediate voltage level, and a positive high voltage level.

Additional features and advantages are realized through the concepts described herein.

BRIEF DESCRIPTION OF THE DRAWINGS

Aspects described herein are particularly pointed out and distinctly claimed as examples in the claims at the conclusion of the specification. The foregoing and other objects, features, and advantages of the disclosure are apparent from the following detailed description taken in conjunction with the accompanying drawings in which:

FIG. 3(*b*) depicts an example trace of current through the load during normal operation, and incorporating aspects described herein;

FIG. 3(*c*) depicts an example of a misfiring in response to noise on the current through the load;

DETAILED DESCRIPTION

Figure 1:
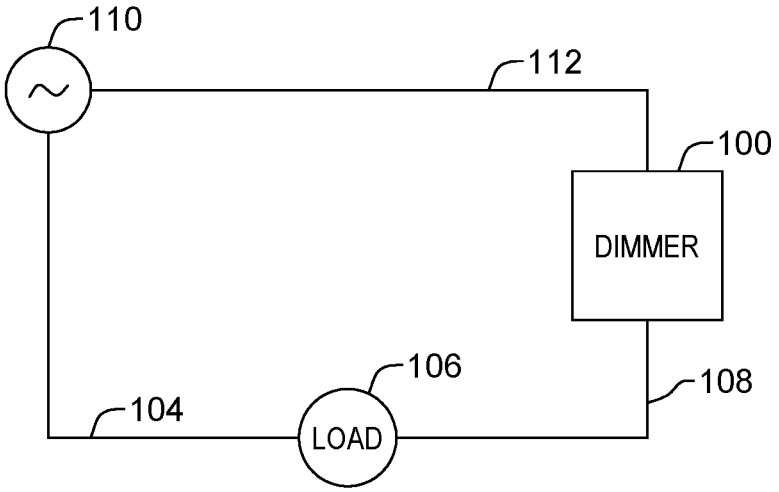
FIG. 1 depicts an example of a dimming system including a two-wire dimmer.

Aspects described herein present zero-crossing detection methods and dimmers incorporating such methods that enable monitoring of the zero-crossing of both half-cycles of the alternating current (AC). This improves synchronization of the dimmer in noisy environments and enables the detection of dimming problems during either half-cycle, to thereby potentially prevent otherwise unrecoverable dimming problems. Such unrecoverable dimming problems are especially prevalent when controlling magnetic low voltage (MLV) loads. Accordingly, aspects can detect improper dimmer firing events on either polarity of the half-cycle and restore normal dimmer operations when needed. Improvements in the quality and safety of dimmers with different loads is provided.

To provide synchronization with the zero-crossings, many conventional two-wire dimmers detect the zero-crossing time of one half-cycle and calculate the zero-crossing time of the other half-cycle based on an internal microcontroller timer. Approaches that detect the zero-crossing of one half-cycle and calculate the zero-crossing of the other half-cycle work in some cases but present problems in others. The microcontroller is unable to understand whether switch firing occurs at the proper time, particularly in situations where power line noise causes short power interruptions. Example power line noises are those that occur during the switching of some fan speed controllers located next to the dimmer. In cases of an LED or CFL load, this may cause blinking that occurs during power noise bursts and continues after the noise is no longer present. In the case of an MLV load, asymmetrical firing can cause saturation of the transformer of the MLV load and may damage the load (e.g. lighting fixture) and the dimmer.

Disclosed herein are various load controls, e.g. dimmers, fan speed controls, and digital/electronic lighting controls, for controlling electrical power to a load. Example loads with which aspects presented herein may work include, but are not limited to, lighting loads, such as incandescent, LED, CFL, and MLV lighting loads, as examples.

By way of background, many countries have an electric grid infrastructure that uses alternating current as a power source (referred to herein as an "AC source"). These systems typically include a phase line and a neutral line. The neutral line is sometimes referred to as a return path for the AC source supplied by a phase line. A line is an electrically conductive path that can also be referred to as a "wire". The terms "line", "conductive line", "conductive path,", "conductor," and "wire" are considered herein to be synonymous. Also present is a ground line which provides a low impedance path back to the AC source should a fault occur (e.g. a phase line coming into contact with a metal box). The neutral wire is typically grounded (e.g. electrically bonded with the ground line) at the main electrical panel.

As described above, a two-wire dimmer provides the ability to omit a direct connection to the neutral line, enabling the dimmer to be quickly and easily installed as a replacement for a mechanical switch in the event that a neutral connection is not available. This avoids potentially having to rewire the existing installation, which can be expensive and time consuming.

Two-wire dimmers typically control the power provided to the load by utilizing a solid state switching device to employ phase control, i.e., "chop" the AC waveform (also referred to herein as the "AC wave"). The solid state switching device may include, e.g., one or more Thyristors, Triodes for Alternating Current (TRIACs), Silicon-controlled Rectifiers (SCRs), Metal-Oxide-Semiconductor Field-Effect Transistors (MOSFETs), Insulated-Gate Bipolar Transistors (IGBTs) or other solid state switching devices to perform phase control. During operation, the switching device provides power to the load during a portion of every half-cycle of an AC power source. The ratio between the portions of the half-cycle when power is provided to the load and not provided to the load is dependent on the intensity setting (e.g. firing angle) of the dimmer. In some two-wire dimmers, the dimmer's internal power supply is energized by using a portion of the half-cycle when the solid state switching device is not conducting and enables the provision of power to the dimmer's various components.

Challenges exist in using two-wire dimming systems incorporating a two-wire dimmer. First, since the load affects how much power can be provided to the dimmer, two-wire dimmers may not have their minimum power load requirement met in order to function properly when used with certain low power loads. If the load power rating (or maximum power dissipation) is less than the minimum power load requirement (typically 25-40 W), the dimmer receives inadequate power to operate, causing the dimmer to stop working. Another challenge with two-wire dimmers is that if the load becomes inoperative, e.g., burned-out, the two-wire dimmer cannot power itself (e.g., the conductive path of the load to neutral becomes an open circuit), creating the impression of a broken two-wire dimmer.

Referring to the drawings, FIG. 1 shows a dimming system having a two-wire dimmer 100 (hereafter referred to simply as dimmer 100 for the sake of brevity). Current travels from AC source 110 via phase line 112 through dimmer 100 and through load 106 via load wire or line 108 to AC source 110 via neutral wire or line 104.

Figure 5:
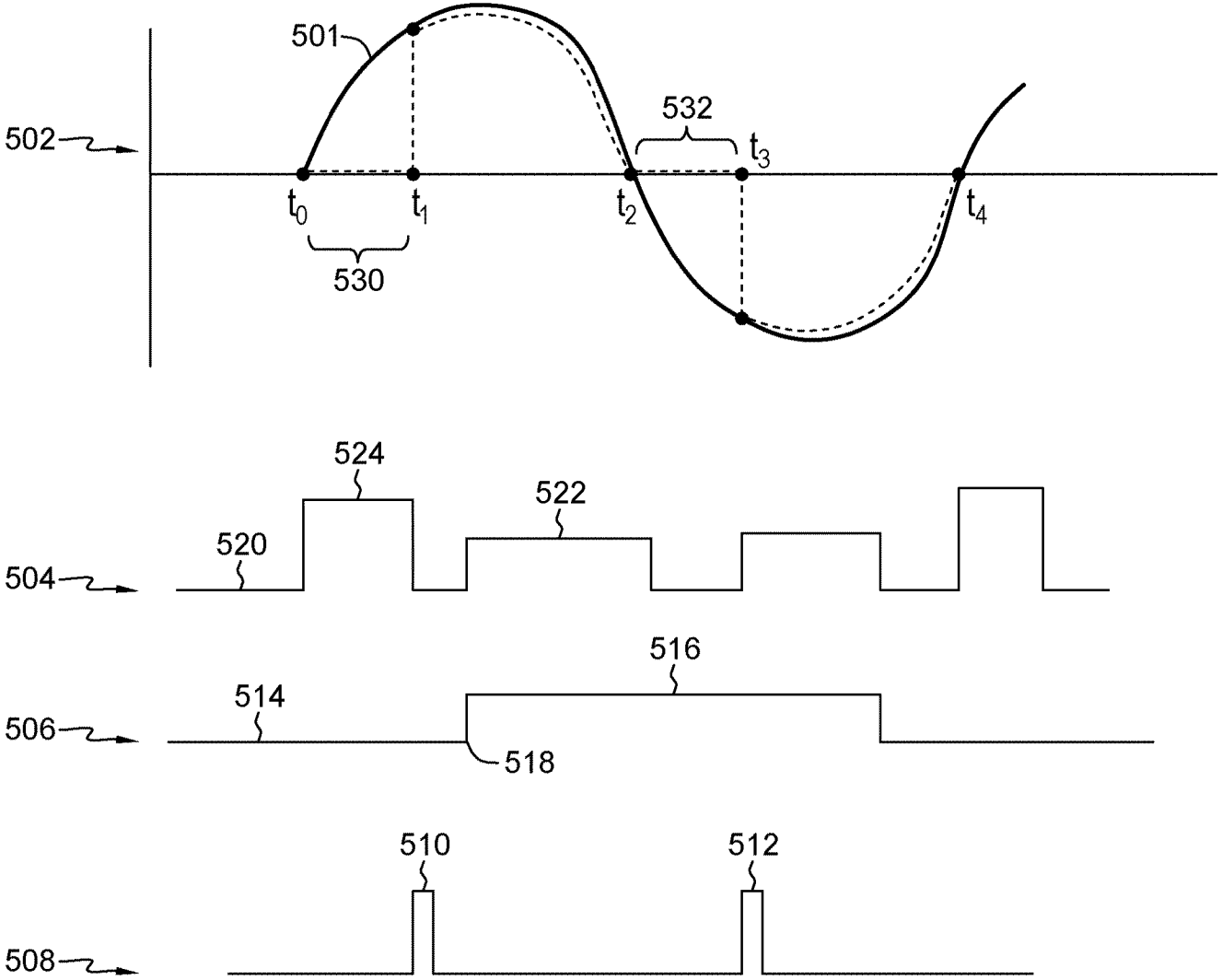
FIG. 5 illustrates traces in the synchronized firing of a dimmer switching circuit in accordance with aspects described herein.

The dimmer 100 includes a circuit to control the power delivered to the load 106 by "chopping" the current coming from AC source 110. A controller may operate a power switch to regulate the power delivered to the load using a phase control technique. The AC source has a sinusoidal waveform that oscillates through cycles. More specifically, each sinusoidal cycle is referred to as a full cycle. Each full cycle includes a positive half-cycle and a negative half-cycle. The positive half-cycle begins at a first zero-crossing (see, e.g., time $t_0$ in FIG. 5 presented herewith) and ends at a midpoint zero-crossing (see, e.g., time $t_2$ in FIG. 5 presented herewith). The negative half-cycle begins at the midpoint zero-crossing time $t_2$ and ends at another zero-crossing (see, e.g., time $t_4$ in FIG. 5 presented herewith). For common 60 Hz power, the entire AC cycle from $t_0$ to $t_4$ lasts 1/60th of a second.

When employing forward phase dimming and a latching power switch (e.g., a TRIAC), at the beginning of the AC cycle, the power switch remains off during a delay period (530 in FIG. 5) until the desired firing angle is reached. At time $t_1$ (see FIG. 5), which occurs between $t_0$ and $t_2$, the TRIAC is turned on by applying one or more pulses to the gate of the TRIAC to connect the AC source to the load. Alternately, a constant/long duration pulse can be supplied to the gate of the TRIAC to hold the TRIAC in a conducting state regardless of the amount of current being conducted through the load (as opposed to discrete pulses). The portion of the AC voltage waveform actually applied to the load is that portion extending from $t_1$ to the end of, or near the end of, the half-cycle at t2. This portion of the AC voltage waveform applied during that portion of the AC cycle is referred to as the conduction period of the positive half-cycle. The TRIAC continues conducting power to the load during this time until it switches off at (or near) the zero-crossing at time $t_2$. TRIACs are self-commutating devices, meaning that they turn themselves off when the current through the device falls below a holding level after the control signal has been removed. The same process is repeated for the negative half-cycle, in which the TRIAC turns on after a delay period 532 at some time $t_3$ (see FIG. 5), which is between $t_2$ and $t_4$, and turns off at (or near) $t_4$. Generally, if the load is purely resistive, the current flowing through the load has essentially the same waveform as the portion of the AC voltage applied to the load, with no phase shift between the current and the voltage. Additionally, delay periods 530 and 532 are generally equal in duration. In alternative embodiments, delay periods 530 and 532 do not have to be generally equal in duration.

Varying the conduction period (i.e. the time of $t_1$ and of $t_3$) varies the percentage of available power delivered to the load, thereby regulating the total amount of power delivered to the load. If the load is a lighting load, regulating the amount of power controls the brightness of the load.

The time periods described above are often described in terms of angles where an entire AC cycle is 360 degrees. Thus, the conduction period ($t_1$ to $t_2$ or time $t_3$ to $t_4$) is commonly referred to as the conduction angle, while the delay period ($t_0$ to $t_1$ or $t_2$ to $t_3$) is typically referred to as the firing angle, the delay angle, or the triggering angle.

It is understood that while other types of power switches, like MOSFETs and IGBTs, are similarly used to control conduction and firing angles, the controlling of these switches may be different from the manner described above.

Some power switches, such as transistors and relays, receive a constant gate signal during the entire conduction period. Other power switches, such as TRIACs and SCRs, have regenerative switching properties that cause them to latch in the conductive state in response to short gate pulse(s) if the load current exceeds a latching level. Once in the conductive state, if the control signal is removed the power switch remains conductive until the current through the switch drops below a holding level, at which point the power switch automatically switches off. This typically occurs when the load current drops below the holding level at or near a zero-crossing.

By way of specific example, a gate pulse may be used for a transistor or other power switch requiring a continuous gate pulse during the entire conduction period from $t_1$ through $t_2$. Thus, the gating operation consumes power during the entire conduction period. This technique can be, and in some instances is, used to maintain a latching power switch such as a TRIAC or SCR in a conducting state when there may otherwise not be enough current to do so.

In examples where only a short gate pulse is used to trigger a TRIAC or SCR at time $t_1$ and latch for substantially the remainder of the half-cycle, the gating operation consumes power only during a small fraction (duration of the short gate pulse) of the conduction period, thereby reducing the overall power consumption.

Figure 3A:
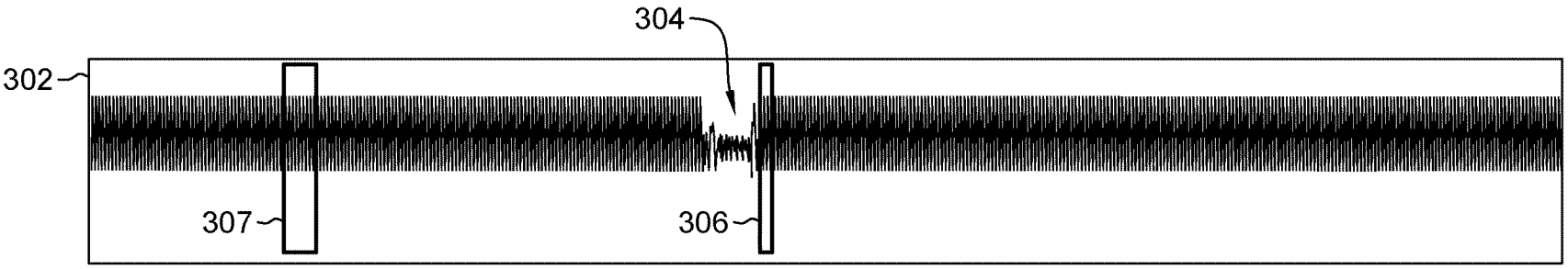
FIG. 3(*a*) depicts an example trace of current through a load over a number of cycles, in which noise and resulting misfiring occurs.
Figure 3B:
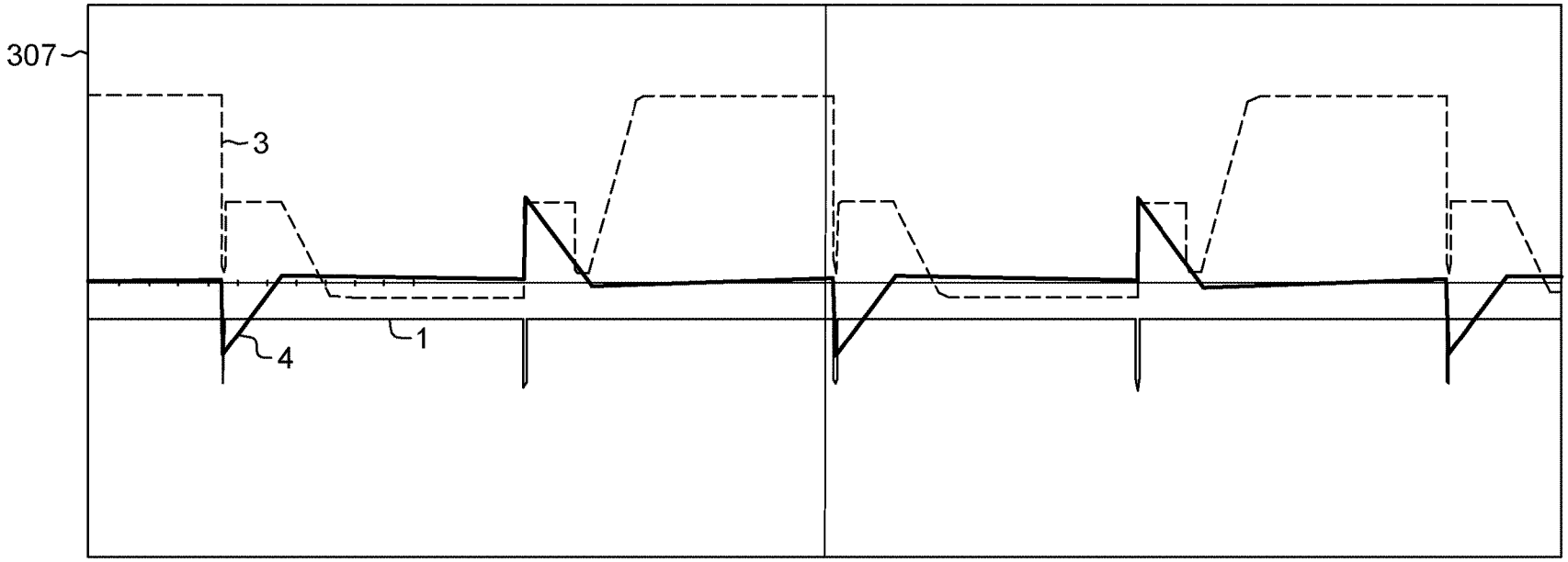
Figure 3C:
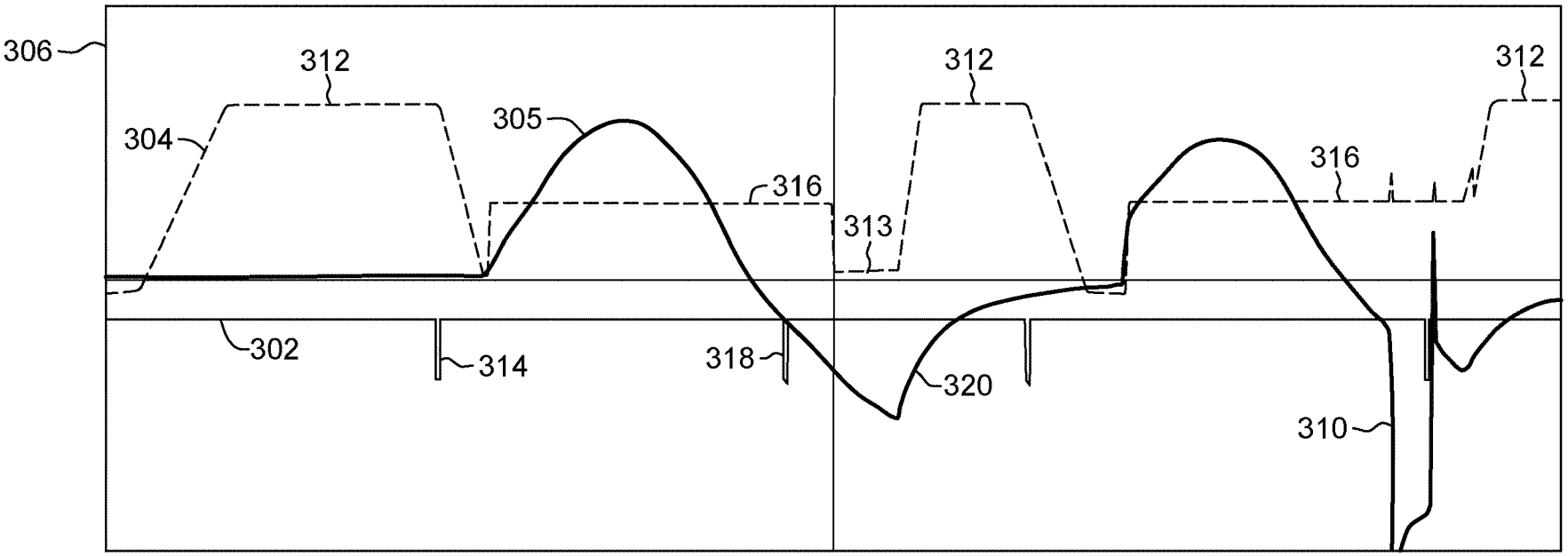

A short gate pulse gating technique may work adequately with a purely resistive load, however a different set of challenges is presented when used with loads having an inductive or other nonlinear characteristics. Referring to FIG. 3(*a*), box 302 shows the trace of the current through the load over a number of cycles. At location 304, noise appears on the current through the load and at box 306, misfiring occurs. Box 307 in FIG. 3(*a*) is a period of normal operation (e.g. without noise on the current through the load), and is depicted as an expanded view with further detail in FIG. 3(*b*). FIG. 3(*c*) is an expanded view of box 306 and shows a misfiring in response to noise on the current through the load. For example, the current drawn by a MLV load, typically does not follow the waveform of the AC source (e.g. input voltage) to the dimmer. Instead, since the current is delayed with respect to the AC voltage, a misfiring event would lead to an asymmetry in the current waveform which leads to the transformer of the MLV load saturating and resulting in a large inrush of current. This is in contrast to a resistive load in which the current corresponds directly with the voltage waveform. If a short gate pulse is applied to the TRIAC during the time period between to and the time at which current draw begins, the MLV load may fail to turn on and/or remain on. That is, since the gate pulse is applied at a time when the MLV load draws no current, the switching device, e.g., the TRIAC, may not turn on at all, and the entire half-cycle of conduction may be missed. Alternatively, if the gate pulse is applied at a time when the load may draw some current, but not enough to latch the TRIAC in the conductive state, the load may receive power only during the duration of the gate pulse, and the result may be a short flash of light from the load, i.e., flickering. Thus, the firing angle corresponding to the time at which current draw begins could represent the limit for maximum brightness, i.e., the maximum possible conduction time.

Likewise, there is typically a firing angle corresponding to a minimum brightness close to the end of the half-cycle. If the TRIAC is gated too late, it may fail to conduct any power to the MLV load or it may only conduct during the gate pulse period if the MLV load does not draw enough current to latch the TRIAC or hold the TRIAC in the conductive state for the appropriate length of time. The result may be a flicker of light, or the lamp may turn off abruptly rather than dimming smoothly as the lower end to the dimming range is approached. Problems at the lower end of the range may be compounded by the decreasing line voltage that is available, as well as the short duration of the conduction period through the TRIAC. The above problems may also be seen with other types of loads (other than MLV) as well.

The firing angles for minimum and maximum brightness for any given load, however, may not be known in advance. Moreover, the firing angle limits may change due to variations in operating conditions such as lamp wattage, number of lamps on the circuit, line voltage, temperature, etc., as well as variations between lamps from different manufacturers, manufacturing tolerances, etc.

One way to assure that the TRIAC will be triggered when operating near the point of maximum brightness is to continue gating the TRIAC during the entire conduction period. Then, even if the gate pulse begins before the time at which current draw begins, the continuous gating assures that the TRIAC will eventually begin conducting when the MLV load begins drawing current at the time at which current draw begins. This may, however, consume more power than the power supply can provide.

Another technique for overcoming uncertainty in the precise timing to trigger switch firing near the points of minimum and maximum brightness involves the use of multiple gate pulses. Using enough pulses over an appropriate length of time may assure that one of the pulses will trigger the TRIAC at a time when the load will draw enough current to latch. Because two-wire dimmers are limited in the amount of power they can draw through the load, use of latching power switches that can be triggered by short pulses may be adopted because it reduces the amount of power required by a controller.

Figure 2:
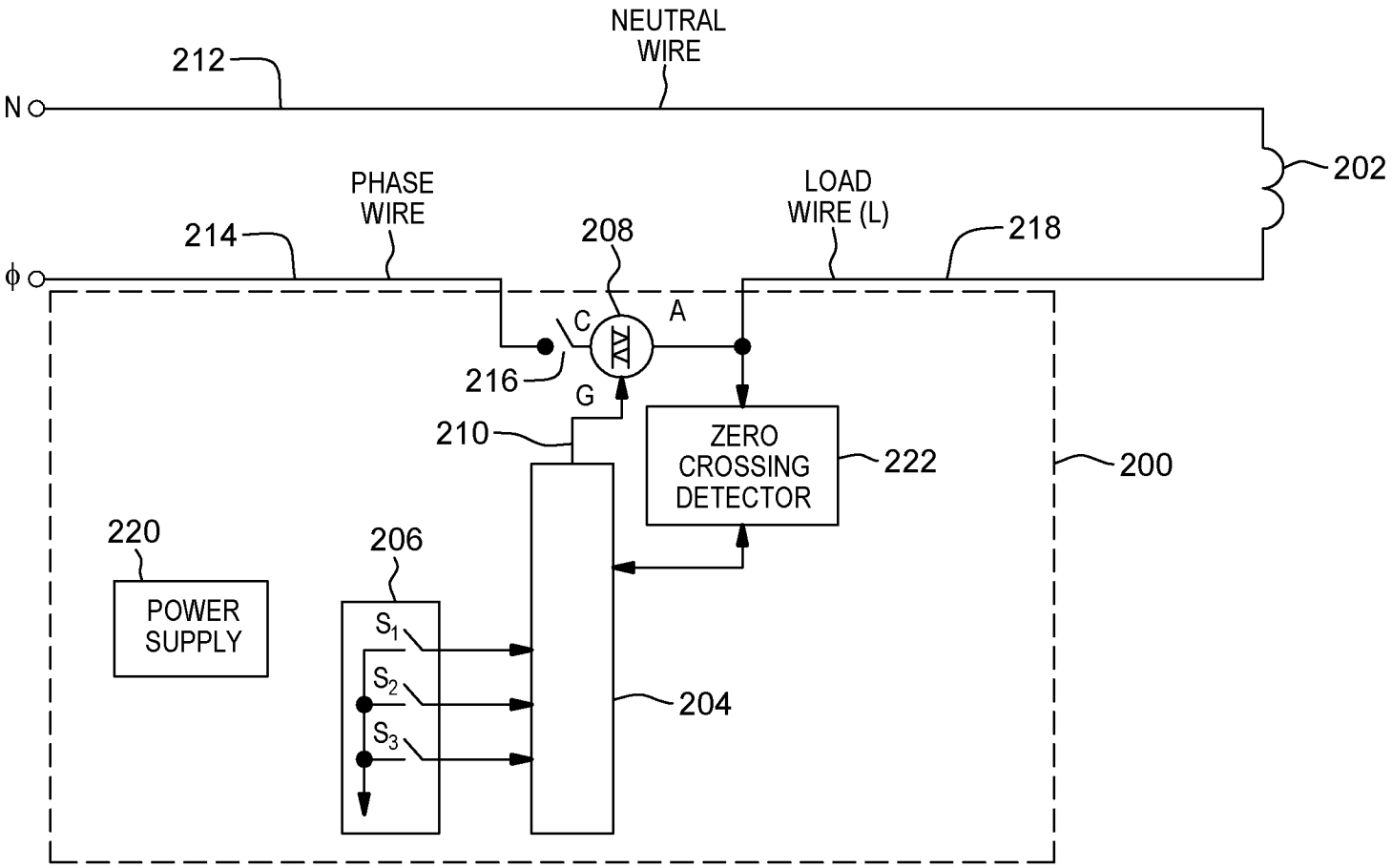
FIG. 2 depicts further details of a two-wire dimmer.

Further details of an example two-wire dimmer are depicted and described with reference to FIG. 2. In FIG. 2, dimmer 200 receives power from the AC source via phase wire 214 and delivers power to load 202 via load wire 218.

The dimmer includes digital control electronics and code for execution. The digital control electronics and/or code can be implemented via a microprocessor/microcontroller (also referred to as a "controller", a "processor", or a "computer processor"). In the present embodiment, controller 204 is coupled to one or more user-accessible actuators 206. A user of dimmer 200 is able to engage actuator 206 and the controller 204 may interpret this as a command (or a set of commands) to perform one or more actions for delivering power to the load 202. In response to the received command information, dimmer 200 can then control delivery of power to the load 202.

Dimmer 200 can control, for example, the amount of current flowing through load 202 by proper activation of TRIAC 208, as described above. TRIAC 208 is a bidirectional three terminal semiconductor device that allows bidirectional current flow when an electrical signal of proper amplitude is applied to its "G" (or gate) terminal via control line 210. TRIAC 208 also has a "C" (or cathode terminal) and an "A" or anode terminal. When an electrical signal is applied to the gate G, TRIAC 208 is said to be gated. When properly gated, current (or other electrical signal) can flow from the "C" terminal to the "A" terminal or from the "A" terminal to the "C" terminal. When TRIAC is not gated or is not properly gated, relatively very little or substantially no current (or no signal) can flow between the "A" and "C" terminals. TRIAC 208 thus acts as an electrically controlled power switch that can allow some or no current flow based on the amplitude of the electrical signal applied to its "G" terminal. Alternatively, the switching component of FIG. 2 (TRIAC 208) could in some examples be implemented as two TRIACs TR1 and TR2, where TRIAC TR1 is controlled by controller 204, which applies a fire signal onto control line 210 to turn on TRIAC TR2, which in turn gates TRIAC TR1 allowing an AC signal to pass through load 202 and back to the AC source via neutral wire 212.

Connected in series to TRIAC 208 is mechanical switch 216. Mechanical switch 216 can be an "air gap switch" that can be activated to stop current flow through the dimmer 200, thus stopping current flow through the load wire 218, load 202 and neutral wire 212 (mechanical switch 216 disconnects power to the dimmer 200 as a whole and load 202 to permit servicing and/or replacement of a light bulb, etc.). TRIAC 208 can be gated to provide current amounts related to intensities of load 202 (for example intensity of the light if load 202 includes a lighting element, fan speed if light 202 includes a fan, etc.) or can be gated to provide substantially no current thus essentially switching off load 202.

Power supply 220 is provided to power operation of component(s) of dimmer 200. Power supply may receive power from the phase line 214, in one example. The power supply 220 may power, for instance, operation of controller 204. The controller 204 can be coupled to and communicate with a zero-crossing detector circuit 222. The zero-crossing detector circuit 222 outputs a ZC signal. The controller 204 can use the ZC signal for various timing functions, such as the proper timing of pulses/signals that the controller 204 generates to control TRIAC 208.

Since the controller 204 is usually referenced to the phase line, the power supply 220 to the controller 204 is typically shorted when the switching circuit (e.g. TRIAC) fires. Thus, the ZC signal drops and the controller 204 is unable to make observations from it when it stays in the low state. Consequently, the ZC signal is available to detect the zero-crossing at only one of the two half-cycles; the other zero-crossing of the other half-cycle is calculated. As noted, an issue may present itself when a zero-crossing does not occur when expected (i.e. calculated) because of some power-related event that occurred, such as noise in the supply power line. Specifically, the synchronization between the firing of the dimmer's switching circuit relative to the actual zero-crossings may be lost.

FIG. 3(*c*) illustrates an example of desynchronized firing of a dimmer switching circuit after power line noise, in this example a short power interruption in AC power. The load in this example is an MLV load having a transformer.

Trace 302 in FIG. 3(*c*) is the signal representing firing the TRIAC. Trace 304 is the ZC signal output from a zero-crossing detector circuit and varies generally between discrete levels, including (but not limited in this example to) a High state 312 and a Low state 313. The ZC signal can indicate zero-crossings of the AC wave. Trace 305 is the trace of current through the load. It is seen toward the right side of FIG. 3(*c*) that the current signal (trace 305) is erratic, experiencing extreme fluctuations (e.g. at 310) in this example because the transformer of the load has saturated, resulting in the generation of a much higher current that is dangerous for the transformer and for the dimmer.

The ZC signal varies between a high state (see, e.g., at 312 in FIG. 3(*c*)) and a low state 313. The high and low states correspond to voltage levels. In FIG. 3(*c*), this is shown by the ZC signal rising to the high state, for instance about 5V or about 3.6V in some examples, and falling at approximately the time that the TRIAC is fired at 314. Firing the TRIAC shorts the input to the controller (e.g. 204) and the ZC signal drops as a result.

Conventionally, the ZC signal would fall low and stay low until the next AC phase. FIG. 3(*c*) depicts an issue that occurs as a result of power line noise with a load having a transformer, in that when the second firing happens (318), current is still flowing to the load. Conduction has not stopped, as the TRIAC is still latched, and the firing pulse 318 has no effect as the TRIAC is already latched. The TRIAC finishes conducting and the current (trace 305) drops (at about 320) to about zero. This represents a misfiring of the TRIAC, creating asymmetry for the load's transformer, and causing the transformer to separate and therefore cause the current peak at 310.

However, as is also illustrated in FIG. 3(*c*) and explained in further detail herein, a controlled bias, for instance a pull-up resistor, may be selectively enabled (i.e. to electrically couple to a ZC input of the controller) by the controller to pull the ZC signal up from the low state to a higher state 316 (referred to herein as an 'intermediate' state or intermediate positive voltage level). In this example, the ZC signal 304 is pulled-up to intermediate level 316 between high (312) and low (313) voltages. In particular examples, the high positive voltage level 312 is substantially 5V or substantially 3.3V, the intermediate positive voltage level 316 is substantially 2.5V or substantially 1.6V, and the low voltage level 313 is substantially 0V, e.g. −0.5V or −0.7V. By "substantially" or "about" in this context is meant within +/−10% of the value, or within 0.2V. The low voltage level and high positive voltage level may be clamped at a predetermined value by a clamping diode.

In this example, the timing of enabling the pull-up resistor is relative to firing the TRIAC. After firing the TRIAC, the controller (e.g. 204) enables the pull-up resistor. Pulling the ZC signal up to a sufficient level (the intermediate level, for instance at least halfway between the low and high levels) enables the controller (e.g. 204) to sense the next zero-crossing via the ZC signal that has been pulled-up. This is described in further detail with reference to FIG. 5. In some examples, the bias is enabled within 200 microseconds after the firing of the TRIAC.

Selectively enabling the controlled bias to raise the voltage level of the ZC signal from the low voltage level to the positive intermediate voltage level enables the dimmer to detect the second zero-crossing, rather than, or in addition to, calculating that second zero-crossing of the full cycle. Therefore, the zero-crossings at both half-cycles can be sensed. Sensing the ZC signal on the transitions between the positive and negative half-cycles additionally enables the detection of error conditions, such as power events, that can lead to desynchronization of the switching circuit firing as illustrated in FIG. 3(*a*).

Figure 4:
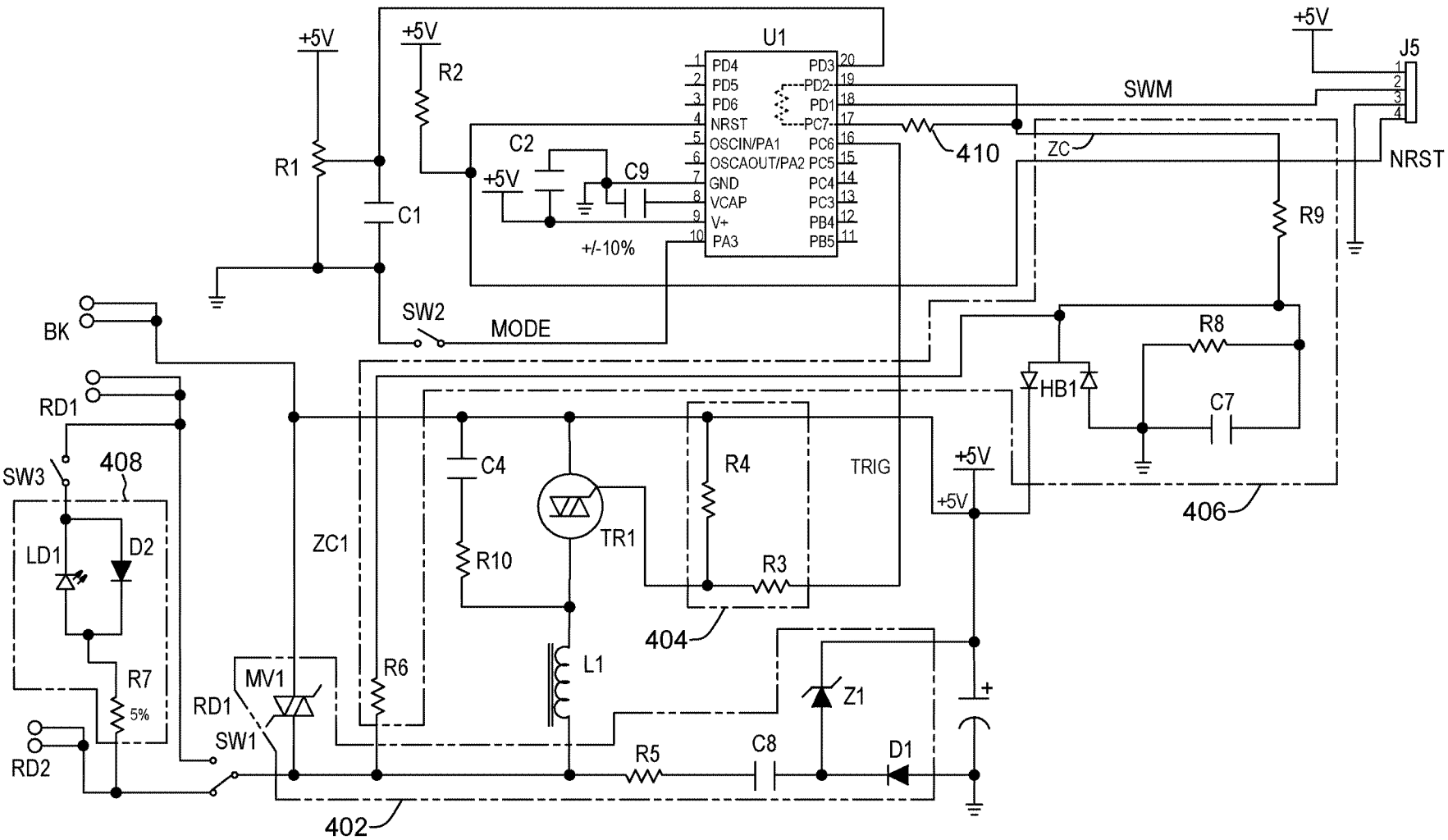
FIG. 4 depicts an example schematic of a dimmer in accordance with aspects described herein.

FIG. 4 depicts an example schematic of a dimmer in accordance with aspects described herein. Line input BK is connected to the phase line such that the AC source is electrically coupled to a power supply circuit 402 of the dimmer, in particular metal-oxide varistor (MOV) component MV1, resistor R5, capacitor C8, Zener diode Z1, and diode D1, which create the +5V power output. Terminals RD1 and RD2 are output terminals, at least one of which is electrically coupled to the load line.

TRIAC TR1 is the power switch that delivers power to the load. Inductance L1 smooths the transition when TRIAC TR1 switches. Resistor R10 and capacitor C4 form a snubber circuit to facilitate proper TRIAC commutation. Resistors R3 and R4 are the drive circuit 404 for TRIAC TR1.

Zero-crossing detector circuit 406 includes high-impedance resistor R6, resistor R8, pull-down resistor R9, diode half-bridge HB1, and capacitor C7. Diode half-bridge HB1 limits the (relatively high, e.g. 120V) power supply voltage. Resistor R8 is a divider for the zero-crossing circuit and capacitor C7 is for filtering. Resistor R9 is for circuit protection.

Capacitors C2 and C9 are internal regulators for the power supply of the controller U2. Resistor R2 is a reset to control a reset function of the dimmer. A slide potentiometer Resistor R1 and capacitor C1 is used to set a dimming (e.g. brightness) level for the dimmer. Switch SW2 is used to program the minimum level or 'kickstart' of the dimmer, referring to an operating mode designed to improve performance when flickering occurs in the load in the low end range of dimming.

LED LD1, diode D2 and resistor R7 form an indicator circuit 408 of the dimmer, with switch SW3 being a selector switch that controls whether the LED circuit 408 is energized.

Connector J5 (top right portion of FIG. 4) is a connector for programming the device, i.e. through communication with and programming of the controller U1. J5 is connected to power (+5V), ground, and reset (NRST) lines, and communication (SWM) line to program the controller U1.

Controller U1 includes inputs and/or outputs 1 through 20, such as pins or other connectors, and each such input/output is uniquely labeled (e.g. PD, PC, PB, NRST, etc.). Pin 19 (labeled PD2) is the zero-crossing input of the controller U1 that couples to the zero-crossing detector circuit, in particular resistor R9 thereof. The zero-crossing detector circuit 406 is configured to output a ZC signal on the ZC line indicative of zero-crossings of the AC wave on the line input BK. In accordance with aspects described herein, the ZC signal has a voltage level indicative of zero-crossings of the AC power, and has a substantially square waveform varying between a low voltage level of substantially zero, a positive intermediate voltage level (as a result of enabling the bias), and a positive high voltage level. It is understood that the meanings of low, intermediate, and high are based on their relation to each other.

Referring to FIG. 3(*b*), which depicts an example trace of current through the load during normal operation, and incorporating aspects described herein, trace 1 is the signal representing the timing of TRIAC firing, trace 3 is the zero-crossing signal, and trace 4 is the trace of current through the load. To explain a cycle, after the second firing pulse of trace 1, the ZC signal (trace 3) goes from low to high and stays high until firing (approximately the middle of FIG. 3(*b*)). After this firing, the ZC signal falls low. In the prior art, the ZC signal would stay low until the next positive half cycle. But here, the pull-up resistor is enabled near immediately after firing in this example to pull the ZC signal up to the intermediate level (e.g. while voltage on R6 of FIG. 4 is −0V). On the next negative half-cycle, voltage on R6 goes to High negative, thus pulling the ZC signal back to about 0V even though the control may continue to keep the pull-up enabled. Upon the next firing, the voltage on R6 goes back to 0 from High negative, and thus the ZC signal goes back to intermediate level on account that the pull-up remains enabled. At some time between the firing and the expected the next half cycle, the pull-up can be disabled, and the ZC signal goes back to 0V before the next positive half cycle.

In accordance with aspects described herein, a controlled bias, for instance a pull-up resistor, is arranged and configured to be selectively enabled by the controller U1 to electrically couple to the zero-crossing input. In some examples, the controlled bias is provided external to the controller U1. For instance, as depicted in FIG. 4, bias (resistor 410) is positioned in the dimmer circuit with one end coupled to the ZC line between R9 and pin 19 and the other end coupled to another input (such as an otherwise unused pin 17) of the controller U1. Pin 17 serves as a control input for the pull-up resistor 410. The controller U1 could then selectively enable or disable the bias 410 (for example by switching the line between 0V (ground) and positive voltage, e.g. 5V or 3.3V) via that control input 17.

While an externally-provided resistor (or other type of controlled bias) can, in some scenarios, provide more tolerance, therefore more precision, than an internally-provided bias, in other examples, the bias is disposed internal to controller U1 (e.g. as an internal pull-up resistor) that, when enabled, pulls-up the ZC signal on Pin 19 from a lower level (e.g. about 0V) to a higher level (some positive voltage, e.g. 1.6V or 2.5V). An example such internal resistor is depicted as an optional/alternative aspect in FIG. 4 (using dashed lines to indicate that it could optionally be substituted for resistor 410), in which an internal resistor (internal to the controller U1) connects pins 17 and 19 of the controller as is seen in FIG. 4.

In a particular embodiment, the bias is connected to the ZC input (pin 19) and a control pin of the controller U1, which controllably switches between 0V and a supply voltage, e.g. +5V. Referring to FIG. 4, resistor R8 is depicted as being connected to resistor R9 and the other end to ground. As an alternative to providing resistor 410, in one example, instead of connecting the ground end of resistor R8 to ground, it could instead connect to a pin (e.g. Pin 17) of the controller U1 that is switched between ground (to disable) and +5V (to enable) pull-up by resistor R8 to pull-up the ZC signal.

Thus, enablement of the controlled bias to effect the pull-up can be done by, as one example, electrically switching the bias on the ZC line via the control pin. The controller U1 can control a switch via internal components to enable/disable the bias via the control pin.

Configuration of the dimmer with the controlled bias as described herein provides the ability to sense AC power zero-crossings on both half-cycles, rather than an alternative of sensing the zero-crossing on one half-cycle and calculating the zero-crossing on the other half-cycle. On the positive half-cycle, the ZC pin 19 of the controller is programmed as high impedance and the controller U1 reads the voltage of the ZC signal on the ZC line using the built-in analog-to-digital (AD) converter from divider R6/R8. Voltage on pin 19 is increasing and the controller U1 recognizes a zero-crossing of the AC wave when the voltage reaches a predetermined level. The controller U1 then sets the timer at the desirable firing angle, typically based on the potentiometer setting as set by the user. Firing the switching circuit (e.g. TRIAC, SCR, etc.) shorts the power input to the controller, causing the ZC signal on pin 19 to drop to (or close to) the 0 level (i.e. it shorts the input to the power supply and shorts R6 to no longer have a high voltage).

As described above, the ZC signal would remain at Low (e.g. about 0 volts) under conventional practice (e.g. without the controlled bias) after firing the TRIAC after sensing the first zero-crossing. Because the ZC signal conventionally remained low, the controller U1 cannot sense the next (second) zero-crossing. However, in accordance with aspects described herein, the controller U1 enables the controlled bias to pull-up the voltage of the ZC signal in order to prepare for the next half-cycle. By way of specific example, the controller enables (electrically couples) an internal pull-up resistor that creates a divider (internal resistor and R9/R8) between +5V and GND, setting the voltage on pin 19 at some level between +5V and 0V, for example 2.5V. This sets the level of the ZC signal (voltage) on ZC pin 19 at some positive level between the high (+5V) and low (0V) states. In some embodiments, this intermediate level is close to half of the power supply voltage. When, during the next half-cycle, resistor R6 is pulled low, the microcontroller U1 can detect the resulting change in the ZC signal from the intermediate level to about 0V, correctly identify the ZC, and enable the controller U1 to prepare the timer for firing in that next half-cycle. In other words, pulling-up the ZC signal enables the controller U1 to detect the next zero-crossing on account of the ZC signal being at least at some intermediate level between the High and Low positive power levels and being pulled down form that intermediate level. Since the actual (as opposed to assumed) ZC is sensed in this operation, firing of the switching circuit can be synchronized properly with the AC power.

After enabling the bias, detecting the second ZC, and waiting for the delay period, the controller fires the TRIAC for the second conductive period. Then after filing the TRIAC, the controller U1 disables the controlled bias to prepare for the next (positive) half-cycle, and starts looking for the next positive half-cycle. This process of detecting the first ZC signal with the ZC signal in the High state, enabling the controlled bias to pull-up the ZC signal after it falls to Low, detecting the next zero-crossing, and disabling the controlled bias can iterate for each full cycle.

FIG. 5 illustrates traces in the synchronized firing of a dimmer switching circuit in accordance with aspects described herein. The traces are shown stacked for clarity. Trace 502 depicts the sinusoidal AC power wave 501 from the AC source (the solid line). The dashed line on trace 502 indicates current through the load based on firing angles defined by times $t_1$ and $t_3$. Time $t_0$ is the start of a full phase that includes a positive half-phase from time $t_0$ to time $t_2$ and a negative half-phase from time $t_2$ to time $t_4$. Time $t_1$ is the first firing time of the TRIAC to enable conduction of the power to the load for the remainder of the positive half-phase. Similarly, time $t_3$ is the second firing time of the TRIAC to enable conduction of AC power to the load for the remainder of the negative half-phase.

Trace 508 represents the TRIAC firing signal, with pulse 510 delivered at the first firing time $t_1$ and pulse 512 delivered at the second firing time $t_3$.

Trace 506 is a square wave depicting the timing of the enablement of the controlled bias. A high state (516) signifies when the controller is enabling the bias. A low state (514) signifies when the controller is not enabling the bias. Here it is seen that the time of enabling the bias extends from some time (e.g. about 200 microseconds) after the first firing (510) of the TRIAC to some time after the second firing (512) of the TRIAC. During this time of enablement, the AC power transitions from the positive half-cycle to the negative half-cycle at time $t_2$. This transition can be accurately sensed by the controller.

Trace 504 is the ZC signal, a substantially square waveform varying between low 520, intermediate 522, and high 524 voltage levels. The ZC signal is high from time $t_0$ to $t_1$ and falls low when the TRIAC is fired, as explained previously. Under prior art practices, this ZC signal would remain low until it rises high on the next positive half-cycle after time $t_4$. However, in accordance with aspects described herein, enablement of the controlled bias (indicated at 518) after the first firing 510 raises the ZC signal to the intermediate level 522. This enables the controller to sense the zero-crossing at $t_2$. For instance, the pull-up is enabled after the first firing and pulls ZC signal to the intermediate level (e.g. while voltage on R6 in FIG. 4 is 0V). The voltage on R6 goes to High negative on the next negative half-cycle at $t_2$ until time $t_3$. This pulls the ZC signal 504 back to 0V (from intermediate level 522) even though with the pull-up remains enabled (see 506). The ZC signal remains low until the second firing at $t_3$, when R6 goes back to 0V. When this occurs, the ZC signal goes back to intermediate level since the pull-up remains enabled during this time. This period of time that includes the transition from the intermediate level to the low level and then back to the intermediate level is seen in the ZC signal 504 between times $t_2$ and $t_3$ and thus the zero-crossing at time $t_2$ may be observed. At some time between the second firing at $t_3$ and the expected the next half-cycle (negative to positive transition), the bias enablement ceases and the ZC signal 504 drops back to approximately 0V before the next positive half-cycle.

It is noted that for the positive half-cycles, before firing the switching circuit, the ZC signal is High (above zero) and drops to low before being pulled-up to the intermediate level. For the negative half-cycles, the ZC signal is initially Low (starting at/near 0V until time $t_3$) after having been pulled low, despite enablement of the bias during that time. After firing at 512, the ZC signal level changes from Low back to intermediate for as long as the bias remains enabled.

Detection of zero-crossings on both the positive-to-negative and negative-to-positive transitions in accordance with aspects described herein may eliminate the need to calculate timing of the second zero-crossings. However, separate calculations for the timing of zero-crossings, per conventional practice, could also be performed in some embodiments, if desired.

Using the approaches described herein enables problems to be detected when the switching circuit fails to properly fire due to noise or other power related issues that cause the dimmer to lose its synchronization between switching and the AC phase. At that point, the controller U1 can temporarily stop firing the switching circuit and re-synchronize with the AC wave after the issue passes.

In the example of FIG. 3(*c*), the dimmer is misfired (too late) during the positive half-cycle, and current through the load (Trace 306) continues through the negative half-cycle. At firing time, voltage on the ZC pin stays high during the negative half-cycle (near point 318) and current through the load becomes asymmetrical. In cases of an MLV load, this can cause an increase of current through the MLV load, audible noise, and damage to the transformer if sustained. Because in this situation the dimmer fires on the positive half-cycle when the ZC signal is Low and on the negative half-cycle when ZC is High, the dimmer detects this as misfire condition and resets itself to restart correct operation. Firing on the positive halfcycle when the ZC signal is Low and firing on the negative halfcycle when ZC signal is High is a misfire condition.

As noted, the controlled bias can reside internal to or external to the controller U1. In the internal embodiment, the bias can couple pin 19, the ZC input, to supply voltage (VDD) of the controller U1. Alternatively, the bias can be an external bias coupled between a supply voltage of the dimmer and another pin of the controller U1 (e.g. an otherwise unused pin) and the controller U1 can be configured to enable and disable the external bias by signaling the external bias on the pin. As yet another option, it is possible for the external bias to create a divider together with R8 when (referring to FIG. 4) the end connected to GND is instead connected to the microcontroller pin so the microcontroller can alternate this connection between GND (low) and +5V (high).

Accordingly, described herein are various embodiments of dimmers with improved noise immunity. The dimmers may be two-wire dimmers for controlling conduction of a supply of alternating current (AC) power to a load. In an embodiment, the dimmer includes a line input terminal and a load output terminal. The line input terminal is configured to be electrically coupled to the supply of AC power, and the load output terminal is configured to be electrically coupled to the load. The dimmer also includes a switching circuit electrically coupled in series between the line input terminal and the load output terminal. The switching circuit is configured to be selectively controlled between an ON state and an OFF state, and has a control input configured to receive a firing signal. The dimmer also includes a zero-crossing detector circuit configured to output a zero-crossing signal having a voltage level indicative of a zero-crossing of the AC power, the zero-crossing signal having a substantially square waveform varying between a low voltage level of substantially zero, a positive intermediate voltage level, and a positive high voltage level. The dimmer also includes a controller having a zero-crossing input configured to receive the zero-crossing signal. The dimmer additionally includes a selectively enabled bias arranged and configured to be selectively electrically coupled to the zero-crossing input. The controller is configured to selectively enable the bias to raise the voltage level of the zero-crossing signal from the low voltage level to the positive intermediate voltage level, and execute a synchronization algorithm to periodically provide the firing signal to the control input in accordance with a timing of the AC power. An example of the controlled bias is a resistor or, as another possibility, two different resistors each controlled by microcontroller pins. One pin switches between a pull-up state and a high impedance state and the other pin switches between a pull-down state and a high impedance state. The controller can be configured (for instance by way of executing code/instructions programmed into the dimmer) to selectively control the switching circuit to synchronize firing of the switching circuit with respect to the AC wave, selectively enable the bias to raise the voltage level of the zero-crossing signal from the low signal level (e.g. at or about 0v) to the positive intermediate voltage level (e.g. between 0V and power supply level, for instance about 2.5V for a 5V power suppler or about 1.6V for a 3.3V power supply, as examples), and detect the zero-crossings of the AC wave using the intermediate voltage level.

In some embodiments, the controller is further configured to detect the positive intermediate voltage level to confirm the switching circuit is in the ON state. If the controller cannot confirm the switching circuit is in the ON state, the controller may be further configured to initiate a restart of the synchronization algorithm. In particular examples, when the bias is not enabled, the zero-crossing signal is at: (i) the low voltage level if the switching circuit is in the ON state, (ii) the low voltage level if the AC power is within a negative half-cycle, or (iii) the positive high voltage level if the switching circuit is in the OFF state during a positive half-cycle of the AC power, and when the bias is enabled, the zero-crossing signal is at the positive intermediate voltage level if the switching circuit is in the ON state.

The bias can be enabled during the positive half-cycle after the firing signal is provided to the control input. The firing signal can be a pulse and the bias can be enabled within, e.g., about 200 microseconds (+/−up to 10% more or less) after the pulse. The bias can remain enabled until after the firing signal is provided to the control input during the negative half-cycle.

The synchronization algorithm can use a first zero-crossing and a second zero-crossing of the AC power, where the first zero-crossing is detected during a transition from a negative half-cycle to a positive half-cycle, and the second zero-crossing is detected during a transition from the positive half-cycle to the negative half-cycle.

The bias can include a pull-up resistor, which can be an internal pull-up resistor of the controller, or a resistor that is external to the controller, as examples. In a particular example, an external pull-up resistor is electrically coupled between a supply voltage of the dimmer and a pin of the controller, and the controller is configured to selectively enable the external pull-up resistor by energizing the external pull-up resistor on the pin. As another example, the controller can include an output pin and the external pull-up resistor can be electrically coupled between the zero-crossing input and the output pin of the controller, and the controller is configured to selectively enable the external pull-up resistor via a signal on the output pin.

The zero-crossing detector circuit could include the external pull-up resistor, and the controller can be configured to selectively enable the external pull-up resistor by switching the external pull-up resistor between a positive voltage and ground.

In some embodiments, the switching circuit is a first switching circuit, and the dimmer further includes a power supply electrically coupled to the AC power, the power supply having a power output; and a second switching circuit electrically coupled to the selectively enabled bias and the zero-crossing input. The second switching circuit can be configured to selectively electrically couple the zero-crossing input to the selectively enabled bias, the selectively enabled bias can be arranged and configured to be selectively electrically coupled to the power output of the power supply, the controller can be coupled to the first switching circuit and the power output of the power supply, the zero-crossing input can be configured to receive the zero-crossing signal, the controller can be configured to synchronize the closing of the first switching circuit with respect to the zero-crossing indicated by the zero-crossing signal received by the zero-crossing input, based on the second switching circuit being open, the zero-crossing input can be electrically coupled only to the zero-crossing signal and based on the second switching circuit being closed, the zero-crossing input can be also electrically coupled to the power output through the selectively enabled bias and the voltage level of the zero-crossing signal is raised from the low voltage power level to the positive intermediate voltage level. The second switching circuit and the controlled bias can be integral with the controller, as an example. The first switching circuit can be a triode for alternating current (TRIAC) or a silicon controlled rectifier (SCR).

In yet another embodiment, a method is provided of operating a dimmer, the dimmer having a line input terminal configured to be electrically coupled to a supply of AC power, a load output terminal configured to be electrically coupled to a load, a switching circuit electrically coupled in series between the line input terminal and the load output terminal, a zero-crossing detector circuit configured to output a zero-crossing signal having a voltage level indicative of a zero-crossings of the AC power, the zero-crossing signal having a substantially square waveform, a controller including a zero-crossing input configured to receive the zero-crossing signal, and a bias arranged and configured to be selectively enabled by the controller to electrically couple to the zero-crossing input. The method includes (a) determining a firing time based on a desired dimming level and a parameter of the AC power, (b) detecting a first zero-crossing time $t_0$ when the voltage level of the zero-crossing signal transitions from a low voltage level of substantially zero to a positive high voltage level, (c) calculating a time $t_1$ relative to $t_0$ based on the firing time, (d) providing a first firing signal at $t_1$ to the switching circuit, (e) enabling the bias, (f) performing a first detection of whether the zero-crossing signal transitioned to a positive intermediate voltage level, (g) detecting a second zero-crossing time $t_2$ when the zero-crossing signal transitions to the low voltage level, (h) calculating a time $t_3$ relative to $t_2$ based on the firing time, (i) providing a second firing signal at $t_3$ to the switching circuit, (j) performing a second detection of whether the zero-crossing signal transitioned to the positive intermediate voltage level, and (k) disabling the bias.

The method can further include detecting Whether the zero-crossing signal transitioned to the low voltage level after (d), the providing the firing signal at $t_1$ to the switching circuit. Additionally or alternatively, the method can further include detecting that a misfiring of the switching circuit with respect to the AC power has occurred. The detecting that the misfiring has occurred can include confirming whether the transition to the positive intermediate voltage level has been detected by the first detection or the second detection (i.e. (t) or (j)).

In some examples, (b) through (k) is repeated for each full cycle of the AC power, thus the detecting a first zero-crossing time $t_0$, the calculating a time $t_1$ the providing a first firing signal, the enabling the bias, the performing a first detection, the detecting a second zero-crossing time $t_2$, the calculating a time $t_3$, the providing a second firing signal, the performing a second detection, and the disabling the bias can be performed for each full cycle of the AC power.

In an additional embodiment, a zero-crossing detector circuit is provided for use in a dimmer having a switching circuit and a controller. The zero-crossing detector circuit includes an input configured to be electrically coupled to alternating current (AC) power, and an output configured to be electrically coupled to the controller. The zero-crossing detector circuit is configured to provide a tri-state zero-crossing signal (i.e. varying between three voltage levels) to the output. Thus, the tri-state zero-crossing signal can include a low voltage level of substantially zero, a positive intermediate voltage level, and a positive high voltage level.

The positive intermediate voltage level may be used to determine a misfiring of the switching circuit with respect to the AC power.

The zero-crossing detector circuit can further include a bias, for instance that is selectively enabled to selectively electrically couple the bias to the output. When the bias is not enabled, the zero-crossing signal can be at: (i) the low voltage level if the switching circuit is in an ON state, (ii) the low voltage level if the AC power is within a negative half-cycle, or (iii) the positive high voltage level if the switching circuit is in an OFF state during a positive half-cycle of the AC power. When the bias is enabled, the zero-crossing signal can be at the positive intermediate voltage level if the switching circuit is in the ON state.

Although various examples are provided, variations are possible without departing from a spirit of the claimed aspects.

Processes described herein may be performed singly or collectively by one or more controllers, such as controller(s) included in dimmer devices. A controller can be, which can be incorporated on an integrated circuit chip as an example. The controller can include one or more of a complex instruction set and a reduced instruction set, memory and a timer, among other components. In some examples, a controller of the dimmer can be provided by an off-the-shelf semiconductor integrated circuit (i.e., an integrated circuit chip). In some examples, the controller can be provided as a digital control circuit, an analog control circuit, or combined digital and analog control circuit designed to perform certain actions depending on the status of various of its inputs. A controller can include functional components used in the execution of instructions, such as functional components to fetch program instructions from locations such as a cache or memory, decode program instructions, and execute program instructions, access memory for instruction execution, and store results of the executed instructions. A controller for a dimmer can include memory, input/output (I/O) devices, and I/O interfaces/inputs. Alternately, the controller may be coupled to the memory, I/O devices, and I/O inputs via one or more buses and/or other connections. Example memory can be or include volatile and/or non-volatile memory. Memory may be or include at least one computer program product having a set (e.g., at least one) of program modules, instructions, code or the like that is/are configured to carry out functions of embodiments described herein when executed by one or more controllers.

The present disclosure may be a system, a method, and/or a computer program product, any of which may be configured to perform or facilitate aspects described herein.

In some embodiments, aspects of the present disclosure may take the form of a computer program product, which may be embodied as computer readable medium(s). A computer readable medium may be a tangible storage device/medium having computer readable program code/instructions stored thereon. Example computer readable medium(s) include, but are not limited to, electronic, magnetic, optical, or semiconductor storage devices or systems, or any combination of the foregoing. Example embodiments of a computer readable medium include a hard drive or other mass-storage device, an electrical connection having wires, random access memory (RAM), read-only memory (ROM), erasable-programmable read-only memory such as EPROM or flash memory, an optical fiber, a portable computer disk/diskette, such as a compact disc read-only memory (CD-ROM) or Digital Versatile Disc (DVD), an optical storage device, a magnetic storage device, or any combination of the foregoing. The computer readable medium may be readable by a controller, processing unit, or the like, to obtain data (e.g. instructions) from the medium for execution. In a particular example, a computer program product is or includes one or more computer readable media that includes/stores computer readable program code to provide and facilitate one or more aspects described herein.

As noted, program instruction contained or stored in/on a computer readable medium can be obtained and executed by any of various suitable components such as a controller to cause the controller or dimmer to behave and function in a particular manner. Such program instructions for carrying out operations to perform, achieve, or facilitate aspects described herein may be written in, or compiled from code written in, any desired programming language.

Program code can include one or more program instructions obtained for execution by one or more controllers. Program instructions may be provided to one or more controllers, to produce a machine (e.g. a dimmer), such that the program instructions, when executed by the one or more controllers, perform, achieve, or facilitate aspects of the present disclosure, such as actions or functions described herein.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A dimmer for controlling conduction of a supply of alternating current (AC) power to a load, the dimmer comprising:

a line input terminal and a load output terminal, the line input terminal configured to be electrically coupled to the supply of AC power, and the load output terminal configured to be electrically coupled to the load;

a switching circuit electrically coupled in series between the line input terminal and the load output terminal, the switching circuit configured to be selectively controlled between an ON state and an OFF state, the switching; circuit having a control input configured to receive a firing signal;

a zero-crossing detector circuit configured to output a zero-crossing signal having a voltage level indicative of a zero-crossing of the AC power, the zero-crossing signal having a substantially square waveform varying between a low voltage level of substantially zero, a positive intermediate voltage level, and a positive high voltage level;

a controller including a zero-crossing input, the zero-crossing input configured to receive the zero-crossing signal; and a selectively enabled bias arranged and configured to be selectively electrically coupled to the zero-crossing input;

wherein the controller is configured to:

selectively enable the bias to raise the voltage level of the zero-crossing signal from the low voltage level to the positive intermediate voltage level; and execute a synchronization algorithm to periodically provide the firing signal to the control input in accordance with a timing of the AC power.

2. The dimmer of claim 1, wherein the controller is further configured to detect the positive intermediate voltage level to confirm the switching circuit is in the ON state.

3. The dimmer of claim 2, wherein if the controller cannot confirm the switching circuit is in the ON state, the controller is further configured to initiate a restart of the synchronization algorithm.

4. The dimmer of claim 1, wherein:

when the bias is not enabled, the zero-crossing signal is at:

the low voltage level if the switching circuit is in the ON state;

the low voltage level if the AC power is within a negative half-cycle; or the positive high voltage level if the switching circuit is in the OFF state during a positive half-cycle of the AC power; and when the bias is enabled, the zero-crossing signal is at the positive intermediate voltage level if the switching circuit is in the ON state.

5. The dimmer of claim 4, wherein the bias is enabled during the positive half-cycle after the firing signal is provided to the control input.

6. The dimmer of claim 5 wherein the firing signal is a pulse and the bias is enabled within 200 microseconds after the pulse.

7. The dimmer of claim 5, wherein the bias remains enabled until after the firing signal is provided to the control input during the negative half-cycle.

8. The dimmer of claim 1, wherein the synchronization algorithm uses a first zero-crossing and a second zero-crossing of the AC power, wherein the first zero-crossing is detected during a transition from a negative half-cycle to a positive half-cycle, and the second zero-crossing is detected during a transition from the positive half-cycle to the negative half-cycle.

9. The dimmer of claim 1, wherein the bias comprises a pull-up resistor.

10. The dimmer of claim 9, wherein the pull-up resistor is an internal pull-up resistor of the controller.

11. The dimmer of claim 9, wherein the pull-up resistor is a resistor that is external to the controller.

12. The dimmer of claim 11, wherein the external pull-up resistor is electrically coupled between a supply voltage of the dimmer and a pin of the controller, and the controller is configured to selectively enable the external pull-up resistor by energizing the external pull-up resistor on the pin.

13. The dimmer of claim 11, wherein the controller further comprises an output pin and the external pull-up resistor is electrically coupled between the zero-crossing input and the output pin of the controller, and wherein the controller is configured to selectively enable the external pull-up resistor via a signal on the output pin.

14. The dimmer of claim 11, wherein the zero-crossing detector circuit includes the external pull-up resistor, and wherein the controller is configured to selectively enable the external pull-up resistor by switching the external pull-up resistor between a positive voltage and ground.

15. The dimmer of claim 1, wherein the switching circuit is a first switching circuit, and wherein the dimmer further comprises:

a power supply electrically coupled to the AC power, the power supply having a power output; and a second switching circuit electrically coupled to the selectively enabled bias and the zero-crossing input, wherein the second switching circuit is configured to selectively electrically couple the zero-crossing input to the selectively enabled bias;

wherein the selectively enabled bias is arranged and configured to be selectively electrically coupled to the power output of the power supply;

wherein the controller is coupled to the first switching circuit and the power output of the power supply;

wherein the zero-crossing input is configured to receive the zero-crossing signal;

wherein the controller is configured to synchronize the closing of the first switching circuit with respect to the zero-crossing indicated by the zero-crossing signal received by the zero-crossing input;

wherein, based on the second switching circuit being open, the zero-crossing input is electrically coupled only to the zero-crossing signal and based on the second switching circuit being closed, the zero-crossing input is also electrically coupled to the power output through the selectively enabled bias and the voltage level of the zero-crossing signal is raised from the low voltage power level to the positive intermediate voltage level.

16. The dimmer of claim 15, wherein the second switching circuit and the controlled bias are integral with the controller.

17. The dimmer of claim 15, wherein the first switching circuit is a triode for alternating current (TRIAC) or a silicon controlled rectifier (SCR).

18. A method of operating a dimmer, the dimmer comprising a line input terminal configured to be electrically coupled to a supply of AC power, a load output terminal configured to be electrically coupled to a load, a switching circuit electrically coupled in series between the line input terminal and the load output terminal, a zero-crossing detector circuit configured to output a zero-crossing signal having a voltage level indicative of a zero-crossings of the AC power, the zero-crossing signal having a substantially square waveform, a controller including a zero-crossing input configured to receive the zero-crossing signal, and a bias arranged and configured to be selectively enabled by the controller to electrically couple to the zero-crossing input, the method comprising:

determining a firing time based on a desired dimming level and a parameter of the AC power;

detecting a first zero-crossing time $t_0$ when the voltage level of the zero-crossing signal transitions from a low voltage level of substantially zero to a positive high voltage level;

calculating a time $t_1$ relative to $t_0$ based on the firing time;

providing a first firing signal at $t_1$ to the switching circuit;

enabling the bias;

performing a first detection of whether the zero-crossing signal transitioned to a positive intermediate voltage level;

detecting a second zero-crossing time $t_2$ when the zero-crossing signal transitions to the low voltage level;

calculating a time $t_3$ relative to $t_2$ based on the firing time;

providing a second firing signal at $t_3$ to the switching circuit;

performing a second detection of whether the zero-crossing signal transitioned to the positive intermediate voltage level; and disabling the bias.

19. The method of claim 18, further comprising detecting whether the zero-crossing signal transitioned to the low voltage level after the providing the firing signal at $t_1$ to the switching circuit.

20. The method of claim 18, further comprising detecting that a misfiring of the switching circuit with respect to the AC power has occurred.

21. The method of claim 20, wherein the detecting that the misfiring has occurred comprises confirming whether the transition to the positive intermediate voltage level has been detected by the first detection or the second detection.

22. The method of claim 18, further comprising repeating the detecting a first zero-crossing time $t_0$, the calculating a time $t_1$, the providing a first firing signal, the enabling the bias, the performing a first detection, the detecting a second zero-crossing time $t_2$, the calculating a time $t_3$, the providing a second firing signal, the performing a second detection, and the disabling the bias for each full cycle of the AC power.

23. A zero-crossing detector circuit for use in a dimmer having a switching circuit and a controller, the zero-crossing detector circuit comprising:

an input configured to be electrically coupled to alternating current (AC) power; and an output configured to be electrically coupled to the controller;

wherein the zero-crossing detector circuit is configured to provide a tri-state zero-crossing signal to the output, the tri-state zero-crossing signal comprising a low voltage level of substantially zero, a positive intermediate voltage level, and a positive high voltage level.

24. The zero-crossing detector circuit of claim 23, wherein the positive intermediate voltage level is used to determine a misfiring of the switching circuit with respect to the AC power.

25. The zero-crossing detector circuit of claim 23, further comprising a bias.

26. The zero-crossing detector circuit of claim 25, wherein the bias is selectively enabled to selectively electrically couple the bias to the output.

27. The zero-crossing detector circuit of claim 26, wherein:

when the bias is not enabled, the zero-crossing signal is at:

the low voltage level if the switching circuit is in an ON state, the low voltage level if the AC power is within a negative half-cycle, or the positive high voltage level if the switching circuit is in an OFF state during a positive half-cycle of the AC power; and when the bias is enabled, the zero-crossing signal is at the positive intermediate voltage level if the switching circuit is in the ON state.

28. The zero-crossing detector circuit of claim 23, wherein the zero-crossing signal is at the positive intermediate voltage level if the switching circuit is in an ON state.

* * * * *